US011262685B1

(12) United States Patent
Shinohara

(10) Patent No.: US 11,262,685 B1
(45) Date of Patent: Mar. 1, 2022

(54) IMAGE FORMING APPARATUS

(71) Applicant: TOSHIBA TEC KABUSHIKI KAISHA, Tokyo (JP)

(72) Inventor: Eiji Shinohara, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/002,627

(22) Filed: Aug. 25, 2020

(51) Int. Cl.
*G03G 15/20* (2006.01)
*G03G 15/00* (2006.01)

(52) U.S. Cl.
CPC ..... *G03G 15/80* (2013.01); *G03G 15/2039* (2013.01)

(58) Field of Classification Search
CPC ... G03G 15/2039; G03G 15/205; G03G 15/80
See application file for complete search history.

(56) References Cited

U.S. PATENT DOCUMENTS

2005/0169655 A1 8/2005 Koyama et al.
2013/0195493 A1* 8/2013 Hase ..... G03G 15/205 399/69
2020/0257226 A1* 8/2020 Kikuchi ..... G03G 15/2025

FOREIGN PATENT DOCUMENTS

JP 2007-004040 A 1/2007
JP 2007-079293 A 3/2007

* cited by examiner

*Primary Examiner* — Hoang X Ngo
(74) *Attorney, Agent, or Firm* — Foley & Lardner LLP

(57) ABSTRACT

The image forming apparatus has a fixing belt, a heater, a switch, a breaker, and a controller. The fixing belt is configured to circulate. The fixing belt is positioned to contact a sheet to which a toner image is transferred. The heater is configured to heat the fixing belt and thereby heat the toner image via the fixing belt. The switch is configured to selectively supply the heater with electric power provided by a power source. The breaker is connected between the power source and the switch. The breaker is operable in an OFF state and an ON state. The controller is configured to (i) switch the breaker to the OFF state from the ON state and (ii) maintain the breaker in the OFF state when (i) the state of the breaker is in the OFF state and (ii) circulation of the fixing belt is stopped.

20 Claims, 6 Drawing Sheets

IMAGE FORMING APPARATUS

FIELD

Embodiments described herein relate generally to an image forming apparatus.

BACKGROUND

In the related art, there is known an image forming apparatus that fixes a toner image on a sheet by a fixing device. For example, the fixing device heats the toner image by bringing a heated fixing belt into contact with the sheet, and fixes the toner image on the sheet to which the toner image is transferred. Therefore, the fixing device has a heating device for heating the fixing belt. As a heating device, there is a type in which a triac is provided in a transmission path for transmitting electric power. Due to the characteristics of the triac, there is a case where noise from a power source causes the heating device to perform unintended heating. Further, there are also many cases where the fixing device does not detect the temperature of the part heated by the heating device. From the above, there is a case where the image forming apparatus including the fixing device of the type in which the triac is provided in the transmission path for transmitting the electric power causes the heating device to perform the unintended heating due to the noise from the power source and accordingly, the fixing belt is deteriorated.

DETAILED DESCRIPTION

Hereinafter, an image forming apparatus according to an embodiment will be described taking an image forming apparatus 1 as an example with reference to the drawings.

Figure 1:
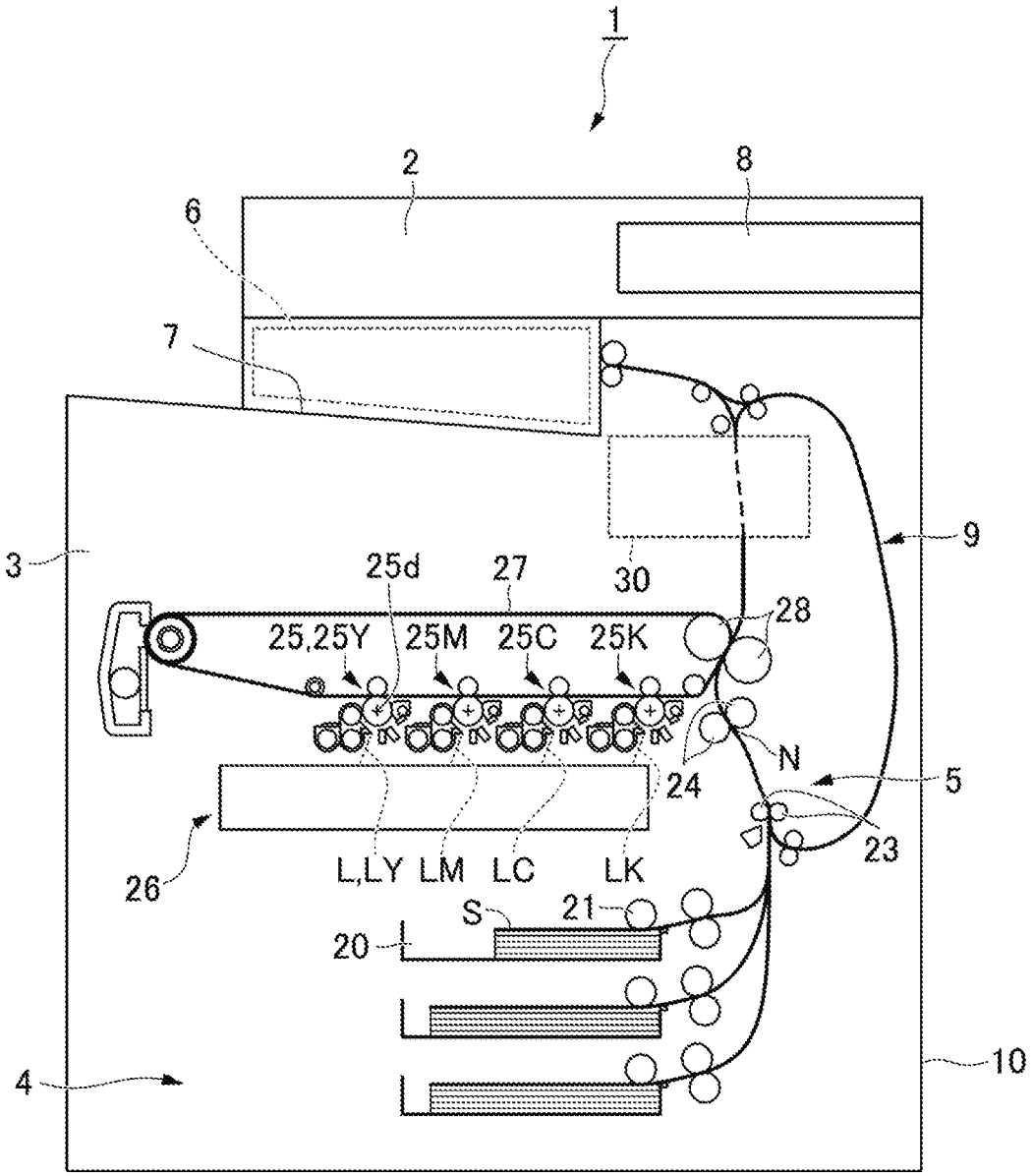
FIG. 1 is a view illustrating an example of a configuration of an image forming apparatus.

FIG. 1 is a view illustrating an example of a configuration of the image forming apparatus 1. The image forming apparatus 1 performs a process of forming an image on a sheet (paper sheet) S.

The image forming apparatus 1 includes a housing 10, a scanner section 2 (a scanner), an image forming unit 3 (a printer), a sheet supply section 4, a conveying section 5 (a conveyor assembly), a paper discharge tray 7, a reversing unit 9, a control panel 8, and a control section 6 (a control unit, a control system, a controller).

The housing 10 forms an outer shape of the image forming apparatus 1.

The scanner section 2 reads image information of a copy target based on brightness and darkness of light. The scanner section 2 generates an image signal corresponding to the brightness and darkness of the read light. The scanner section 2 outputs the generated image signal to the image forming unit 3.

The image forming unit 3 forms an output image with a recording material such as toner based on an image signal received from the scanner section 2 or an image signal received from the outside (e.g., an external source such as a server, a computer, a smart phone, or other electronic device). Hereinafter, for convenience of the description, the output image will be described as a toner image. The image forming unit 3 transfers the toner image to the front surface of the sheet S. The image forming unit 3 heats and pressurizes the toner image transferred to the front surface of the sheet S to fix the toner image onto the sheet S.

The sheet supply section 4 supplies the sheets S one by one to the conveying section 5 at the timing when the image forming unit 3 forms a toner image. The sheet supply section 4 includes a sheet accommodation section 20 (one or more sheet trays) and a pickup roller 21.

The sheet accommodation section 20 stores the sheet S of a predetermined size and type.

The pickup roller 21 picks up the sheets S one by one from the sheet accommodation section 20. The pickup roller 21 supplies the picked-up sheet S to the conveying section 5.

The conveying section 5 conveys the sheet S supplied from the sheet supply section 4 to the image forming unit 3. The conveying section 5 has a conveying roller 23 and a registration roller 24.

The conveying roller 23 conveys the sheet S supplied from the pickup roller 21 to the registration roller 24. The conveying roller 23 abuts the distal end of the sheet S in the conveying direction against a nip N of the registration roller 24.

The registration roller 24 bends the sheet S at the nip N to adjust the position of the distal end of the sheet S in the conveying direction. The registration roller 24 conveys the sheet S corresponding to the timing when the image forming unit 3 transfers the toner image to the sheet S.

Hereinafter, the image forming unit 3 will be described in detail.

The image forming unit 3 includes a plurality of image forming sections 25, a laser scanning unit 26, an intermediate transfer belt 27, a transfer section 28, and a fixing device 30.

The image forming section 25 has a photoreceptor drum 25*d*. The image forming section 25 forms a toner image corresponding to the image signal received from the scanner section 2 or the image signal received from the outside, on the photoreceptor drum 25*d*. The plurality of image forming sections 25Y, 25M, 25C, and 25K form toner images with yellow, magenta, cyan, and black toners, respectively.

A charging device, a developing device, and the like are arranged around the photoreceptor drum 25*d*. A charging device charges the front surface of the photoreceptor drum 25*d*. A developing device contains a developer containing yellow, magenta, cyan, and black toners. The developing device develops the electrostatic latent image on the photoreceptor drum 25*d*. As a result, a toner image of toner of a color is formed on the photoreceptor drum 25*d*.

The laser scanning unit 26 deflects a laser beam L for scanning the charged photoreceptor drum 25*d* to expose the photoreceptor drum 25*d*. The laser scanning unit 26 exposes the photoreceptor drum 25*d* of the image forming sections 25Y, 25M, 25C, and 25K of a color with different laser beams LY, LM, LC, and LK. Accordingly, the laser scanning unit 26 forms an electrostatic latent image on the photoreceptor drum 25*d*.

The toner image on the front surface of the photoreceptor drum 25*d* is primarily transferred to the intermediate transfer belt 27.

The transfer section 28 transfers the toner image primarily transferred onto the intermediate transfer belt 27, onto the front surface of the sheet S at a secondary transfer position.

The fixing device 30 heats and pressurizes the toner image transferred to the sheet S to fix the toner image onto the sheet S.

The reversing unit 9 reverses the sheet S to form an image on the back surface of the sheet S. The reversing unit 9 reverses the sheet S discharged from the fixing device 30 upside down by switchback. The reversing unit 9 conveys the reversed sheet S toward the registration roller 24.

The sheet S on which the image is formed and which is discharged is placed on the paper discharge tray 7.

The control panel 8 is a part of an input section through which an operator inputs information for operating the image forming apparatus 1. The control panel 8 has a touch panel and various hard keys.

The control section 6 controls each component of the image forming apparatus 1. The position of the control section 6 illustrated in FIG. 1 is merely an example, and may be another position inside the image forming apparatus 1.

Figure 2:
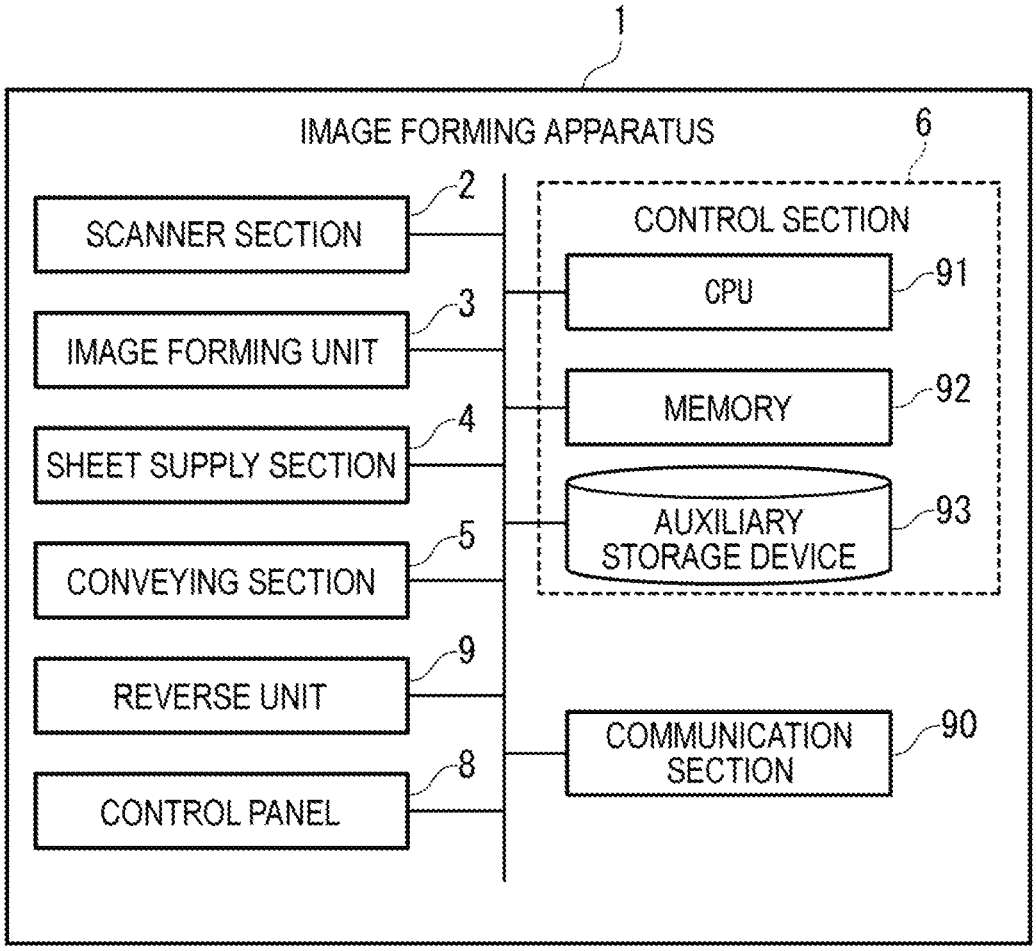
FIG. 2 is a hardware configuration view of the image forming apparatus.

FIG. 2 is a hardware configuration view of the image forming apparatus 1. The image forming apparatus 1 includes a processing circuit, processor, or central processing unit (CPU) 91, a memory 92, an auxiliary storage device 93, and the like which are connected to each other by a bus, and executes various programs. The image forming apparatus 1 functions as an apparatus including the scanner section 2, the image forming unit 3, the sheet supply section 4, the conveying section 5, the reversing unit 9, the control panel 8, and a communication section 90 (a communication interface) by executing various programs.

The CPU 91 functions as the control section 6 by executing various programs stored in the memory 92 and the auxiliary storage device 93. The control section 6 controls the operations of each functional section of the image forming apparatus 1.

The auxiliary storage device 93 is configured by using a storage device such as a magnetic hard disk device or a semiconductor storage device. The auxiliary storage device 93 stores various types of information.

The communication section 90 is configured to include a communication interface for connecting the own device to an external device. The communication section 90 communicates with an external device via a communication interface.

Hereinafter, the fixing device 30 will be described in detail.

Figure 3:
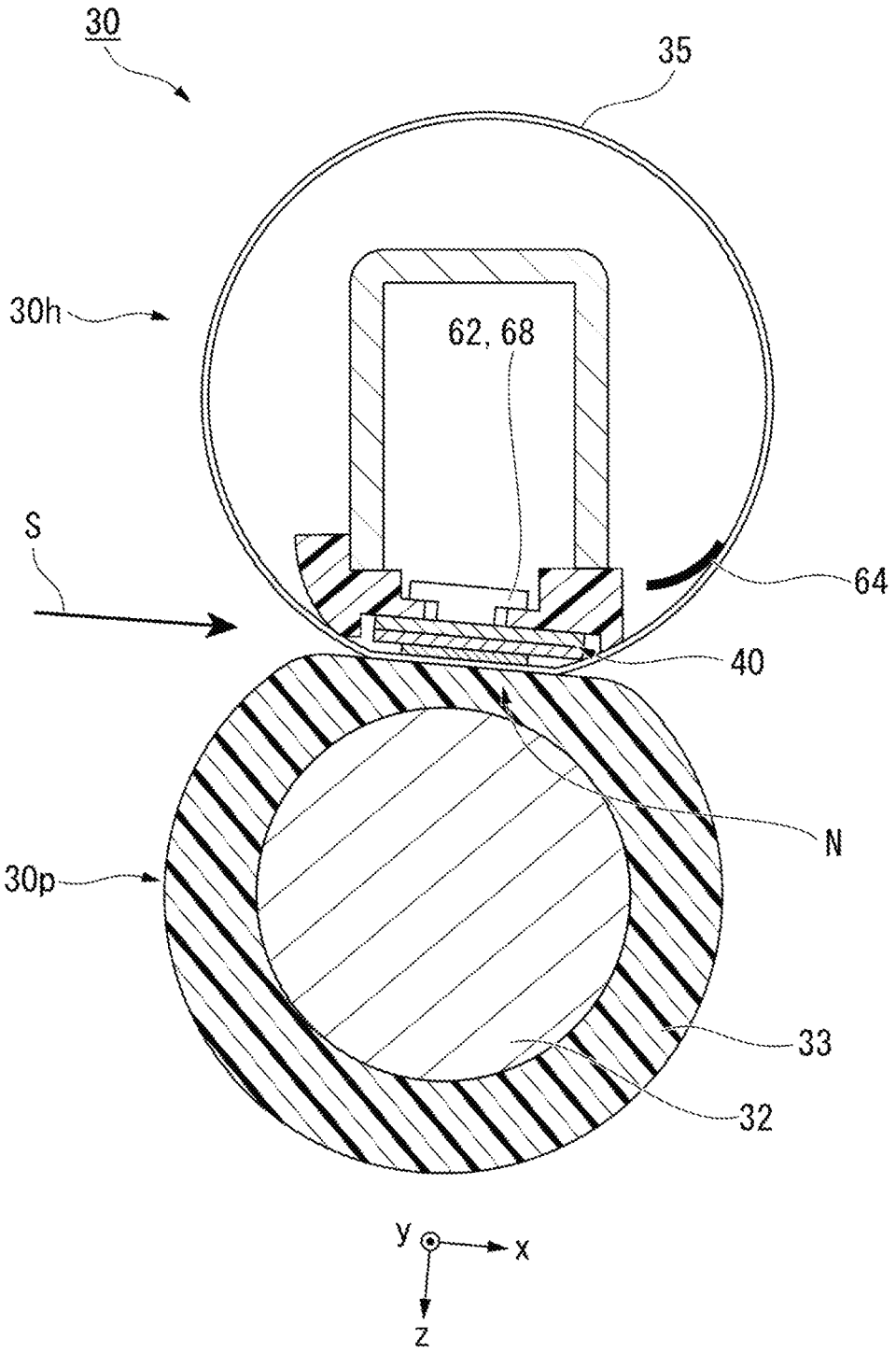
FIG. 3 is a front sectional view of a fixing device.

FIG. 3 is a front sectional view of the fixing device 30. A three-dimensional coordinate system illustrated in FIG. 3 indicates the direction in FIG. 3. Hereinafter, for convenience of the description, an X-axis in the three-dimensional coordinate system illustrated in FIG. 3 will be simply referred to as an X-axis. Further, in the following, for convenience of the description, a positive direction of the X-axis will be referred to as a +x direction. Further, in the following, for convenience of the description, a negative direction of the X-axis will be referred to as a −x direction. Further, in the following, for convenience of the description, a Y-axis in the three-dimensional coordinate system illustrated in FIG. 3 will be simply referred to as a Y-axis. Further, in the following, for convenience of the description, a positive direction of the Y-axis will be referred to as a +y direction. Further, in the following, for convenience of the description, a negative direction of the Y-axis will be referred to as a −y direction. Further, in the following, for convenience of the description, a Z-axis in the three-dimensional coordinate system illustrated in FIG. 3 will be simply referred to as a Z-axis. Further, in the following, for convenience of the description, a positive direction of the Z-axis will be referred to as a +z direction. Further, in the following, for convenience of the description, a negative direction of the Z-axis will be referred to as a −z direction.

The fixing device 30 includes a pressure roller 30*p* and a film unit 30*h*.

The pressure roller 30*p* forms the nip N with the film unit 30*h*. The pressure roller 30*p* pressurizes the toner image on the sheet S that entered the nip N. The pressure roller 30*p* revolves to convey the sheet S. The pressure roller 30*p* has a cored bar 32, an elastic layer 33, and a release layer (not illustrated).

The cored bar 32 is formed in a columnar shape with a metal material such as stainless steel. Both end portions of the cored bar 32 in the axial direction are rotatably supported. The cored bar 32 is rotationally driven by a motor (not illustrated). The cored bar 32 abuts against a cam member (not illustrated). The cam member rotates to move the cored bar 32 toward and away from the film unit 30*h*.

The elastic layer 33 is formed of an elastic material such as silicone rubber. The elastic layer 33 is formed with a constant thickness on the outer circumferential surface of the cored bar 32.

The release layer (not illustrated) is formed of a resin material such as tetrafluoroethylene/perfluoroalkyl vinyl ether copolymer (PFA). The release layer is formed on the outer circumferential surface of the elastic layer 33.

The hardness of the outer circumferential surface of the pressure roller 30*p* is desirably 40° to 70° with an ASKER-C hardness tester under a load of 9.8 Newtons (N). Accordingly, the area of the nip N and the durability of the pressure roller 30*p* are ensured.

The pressure roller 30*p* can move toward and away from the film unit 30*h* by the rotation of the cam member. When the pressure roller 30*p* is moved toward the film unit 30*h* and pressed by a pressurizing spring, the nip N is formed. Meanwhile, when the sheet S is jammed in the fixing device 30, the sheet S can be removed by moving the pressure roller 30*p* away from the film unit 30*h*. The plastic deformation of a tubular film 35 due to the pressure applied to the tubular film 35 by the pressure roller 30*p* is prevented by moving the pressure roller 30*p* away from the film unit 30*h* in a predetermined state. This predetermined state is a state where the tubular film 35 has stopped rotating (for example, during sleep).

The pressure roller 30*p* is rotationally driven by a motor. When the pressure roller 30*p* revolves in a state where the nip N is formed, the tubular film 35 of the film unit 30*h* is driven to rotate. Hereinafter, for convenience of the description, the driven rotation of the tubular film 35 will be referred to as the circulation of the tubular film 35. The pressure roller 30*p* conveys the sheet S in a conveying direction W by revolving in a state where the sheet S is disposed in the nip N.

The film unit 30*h* heats the toner image on the sheet S that entered the nip N. The film unit 30*h* includes a tubular film (tubular body) 35, the heater unit 40, a heater thermometer 62, a thermostat 68, and a film thermometer 64. In the embodiment, the description of other members such as the heat transfer member included in the film unit 30*h* will be omitted.

The tubular film 35 is an example of a fixing belt. The tubular film 35 is formed in a tubular shape. The tubular film 35 has a base layer, an elastic layer, and a release layer in order from the inner circumferential side. The base layer is formed of a material such as nickel (Ni) in a tubular shape. The elastic layer is disposed to be laminated on the outer circumferential surface of the base layer. The elastic layer is formed of an elastic material such as silicone rubber. The release layer is disposed to be laminated on the outer circumferential surface of the elastic layer. The release layer is formed of a material such as PFA resin. The tubular film 35 is provided to be capable of circulating around a predetermined axis. Therefore, the tubular film 35 circulates corresponding to the rotation of the pressure roller 30*p*. When the sheet S enters the nip N during such a circulation, the tubular film 35 comes into contact with the sheet S at a predetermined contact position. Further, the tubular film 35 is heated by the heater unit 40. Therefore, the tubular film 35 can heat the toner image on the sheet S that entered the nip N.

The heater unit 40 is an example of a heating device or heater. The heater unit 40 heats the fixing belt and heats the toner image on the sheet S via the heated tubular film 35.

The heater unit 40 is disposed inside the tubular film 35. The inner circumferential surface of the tubular film 35 is coated with grease (not illustrated). The heater unit 40 comes into contact with the inner circumferential surface of the tubular film 35 via grease. When the heater unit 40 generates heat, the viscosity of grease decreases. Accordingly, the slidability between the heater unit 40 and the tubular film 35 is ensured.

The heater thermometer 62 is, for example, a thermistor. The heater thermometer 62 measures the temperature of the heater unit 40. The thermostat 68 is disposed similarly to the heater thermometer 62. When the measured temperature of the heater unit 40 exceeds a predetermined temperature, the thermostat 68 cuts off the power supply to the heating element of the heater unit 40.

As illustrated in FIG. 3, the film thermometer 64 is disposed inside the tubular film 35 and on the +x direction side of the heater unit 40. The film thermometer 64 comes into contact with the inner circumferential surface of the tubular film 35 and measures the temperature of the tubular film 35. As illustrated in FIG. 3, the position of the tubular film 35 measured by the film thermometer 64 is different from a predetermined position where the tubular film 35 comes into contact with the sheet S, that is, the position heated by the heater unit 40. Therefore, the film thermometer 64 can measure the temperature of the tubular film 35 with high accuracy by measuring the temperature of the tubular film 35 in the middle of the circulation of the tubular film 35.

Figure 4:
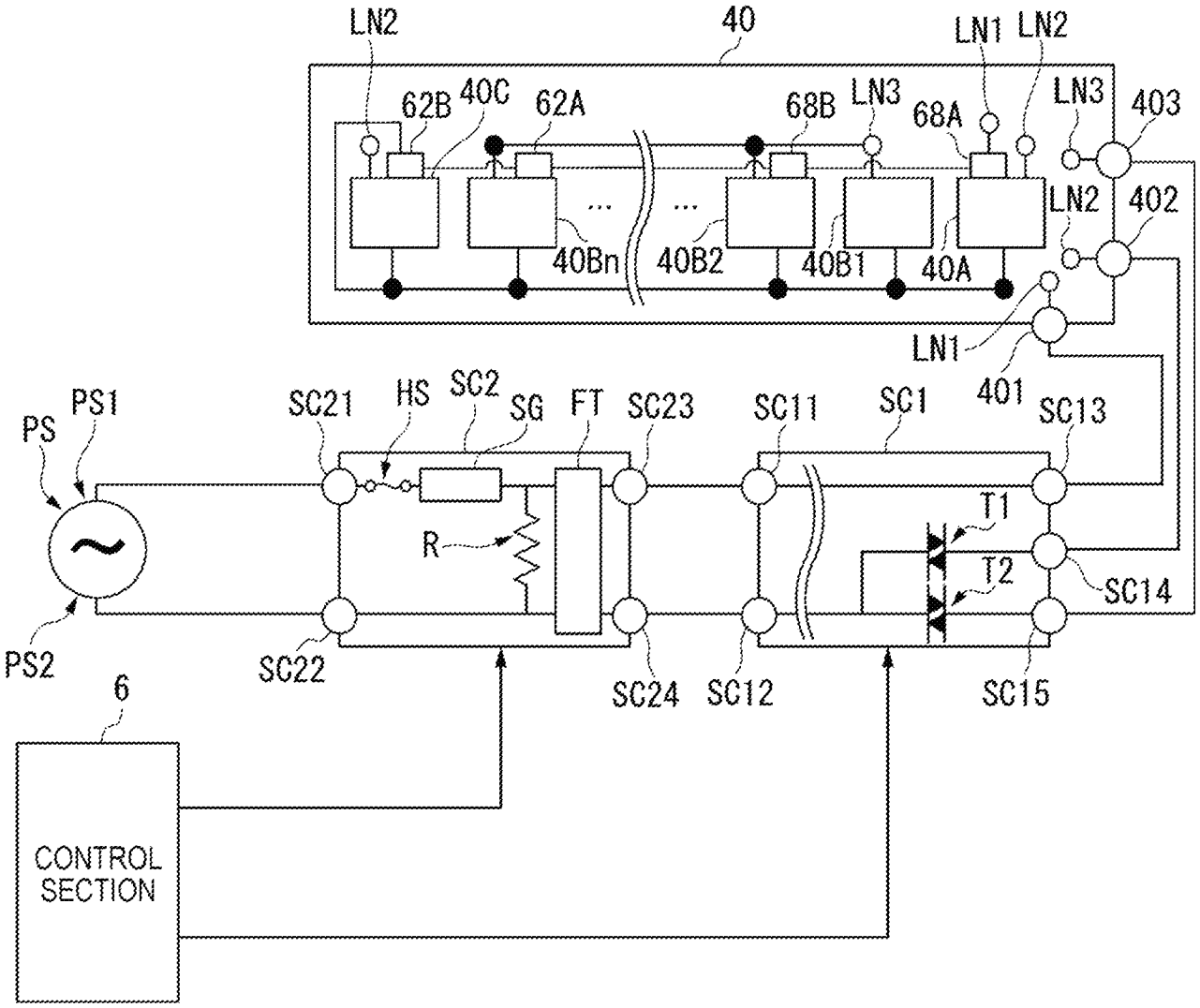
FIG. 4 is a main configuration view of an electric circuit diagram of a heater unit.

FIG. 4 is a main configuration view of an electric circuit diagram of the heater unit 40. In FIG. 4, non-main components such as connectors are omitted. FIG. 4 illustrates a bottom surface view of the heater unit 40, as the heater unit 40. In FIG. 4, a plurality of contacts LN1 are electrically connected to each other by a transmission path. However, in FIG. 4, in order to prevent the drawing from being complicated, the transmission path connecting the plurality of contacts LN1 to each other is omitted. In FIG. 4, a plurality of contacts LN2 are electrically connected to each other by a transmission path. However, in FIG. 4, in order to prevent the drawing from being complicated, the transmission path connecting the plurality of contacts LN2 to each other is omitted. In FIG. 4, a plurality of contacts LN3 are electrically connected to each other by a transmission path. However, in FIG. 4, in order to prevent the drawing from being complicated, the transmission path connecting the plurality of contacts LN3 to each other is omitted. The circuit diagram illustrated in FIG. 4 may be modified, replaced, or deleted within a range that does not impair the function of the image forming apparatus 1 described in the embodiment.

The heater unit 40 includes a substrate (not illustrated), a first end portion heating element 40A mounted on the substrate, n central heating elements, and a second end portion heating element 40C. n may be any integer as long as the integer is 1 or more. In FIG. 4, n central heating elements are illustrated as central heating elements 40B1 to 40Bn. Each of the first end portion heating element 40A, the n central heating elements, and the second end portion heating element 40C is an example of the heating element of the above-described heater unit 40.

Three input terminals such as an input terminal 401, an input terminal 402, and an input terminal 403, are attached to the substrate of the heater unit 40. The input terminal 401 is connected to a contact L1. The input terminal 402 is connected to a contact L2. The input terminal 403 is connected to a contact L3.

Two heater thermometers 62 and two thermostats 68 are attached to the substrate of the heater unit 40. In FIG. 4, the two heater thermometers 62 are illustrated as heater thermometers 62A and 62B. In FIG. 4, the two thermostats 68 are illustrated as thermostats 68A and 68B.

The substrate of the heater unit 40 is a substantially rectangular substrate. The first end portion heating element 40A is mounted on the first end portion which is one of the longitudinal end portions of the substrate of the heater unit 40. A second end portion heating element 40C is mounted on the second end portion which is the other one of the longitudinal end portions of the substrate of the heater unit 40. Between the first end portion heating element 40A and the second end portion heating element 40C, n central heating elements are arranged from the first end portion heating element 40A side toward the second end portion heating element 40C side. These n central heating elements are arranged in the order of the central heating element 40B1, the central heating element 40B2, . . . , and the central heating element 40Bn from the first end portion heating element 40A side toward the second end portion heating element 40C side.

The heater thermometer 62A is disposed, for example, within the area of the central heating element 40Bn. The heater thermometer 62B is disposed, for example, within the area of the second end portion heating element 40C. Each of the heater thermometers 62A and 62B may be configured to be disposed within the area of another heating element included in the heater unit 40.

The thermostat 68A is disposed within the area of the first end portion heating element 40A. The thermostat 68B is disposed within the area of the central heating element 40B2. Each of the thermostats 68A and 68B may be configured to be disposed within the area of another heating element included in the heater unit 40.

One of the two terminals of the thermostat 68A is connected to the contact LN1 via the transmission path. The other one of the two terminals of the thermostat 68A is connected to one of the two terminals of the thermostat 68B via the transmission path. The other one of the two terminals of the thermostat 68B is connected to one of the two terminals of the heater thermometer 62A via the transmission path. The other one of the two terminals of the heater thermometer 62A is connected to one of the two terminals of the heater thermometer 62B via the transmission path. The other one of the two terminals of the heater thermometer 62B is connected to each of the first end portion heating element 40A, the n central heating elements, and the second end portion heating element 40C via the transmission path.

Accordingly, electric power is supplied from the input terminal 401 to the thermostats 68A and 68B and the heater thermometers 62A and 62B. Electric power is also supplied from the input terminal 401 to each of the first end portion heating element 40A, the n central heating elements, and the second end portion heating element 40C.

Of the two terminals of the first end portion heating element 40A, the one terminal which is not connected to the heater thermometer 62B is connected to the contact LN2 via the transmission path. Of the two terminals of the second end portion heating element 40C, the one terminal which is not connected to the heater thermometer 62B is connected to the contact LN2 via the transmission path. Accordingly, electric power is supplied from the input terminal 402 to each of the first end portion heating element 40A and the second end portion heating element 40C.

Of the two terminals of each of the n central heating elements, the one terminal which is not connected to the heater thermometer 62B is connected to the contact LN3 via the transmission path. Accordingly, electric power is supplied from the input terminal 403 to each of the n central heating elements.

An output terminal SC13 of a first switching circuit SC1 is connected to the input terminal 401 of the heater unit 40 via the transmission path. An output terminal SC14 of the first switching circuit SC1 is connected to the input terminal 402 of the heater unit 40 via the transmission path. An output terminal SC15 of the first switching circuit SC1 is connected to the input terminal 403 of the heater unit 40 via the transmission path. The first switching circuit SC1 has two input terminals such as an input terminal SC11 and an input terminal SC12, in addition to the three output terminals such as the output terminal SC13 to the output terminal SC15.

The first switching circuit SC1 is a circuit that supplies the heater unit 40 with predetermined electric power supplied from a power source PS. The first switching circuit SC1 includes two switching elements or switches such as a first switching element T1 and a second switching element T2.

The first switching element T1 is, for example, a triac. The first switching element T1 may be a gate turn-off thyristor (GTO), an insulated gate bipolar transistor (IGBT), or the like instead of the triac.

The second switching element T2 is, for example, a triac. The second switching element T2 may be a gate turn-off thyristor (GTO), an insulated gate bipolar transistor (IGBT), or the like instead of the triac.

The first switching element T1 may be the same type of switching element as the second switching element T2, or may be a different type of switching element from the second switching element T2. However, it is desirable that the first switching element T1 is the same type of switching element as the second switching element T2 for reasons of such as easy control.

In the example illustrated in FIG. 4, the input terminal SC11 of the first switching circuit SC1 is connected to the output terminal SC13 via the transmission path.

In the example illustrated in FIG. 4, the input terminal SC12 of the first switching circuit SC1 is connected to each of the output terminal SC14 and the output terminal SC15 via the transmission path split into two.

In the example illustrated in FIG. 4, the first switching element T1 is connected between the input terminal SC11 and the output terminal SC14. Specifically, the input terminal SC11 is connected to the input terminal of the first switching element T1. The output terminal of the first switching element T1 is connected to the output terminal SC14.

In the example illustrated in FIG. 4, the second switching element T2 is connected between the input terminal SC11 and the output terminal SC15. Specifically, the input terminal SC11 is connected to the input terminal of the second switching element T2. The output terminal of the second switching element T2 is connected to the output terminal SC15.

A gate terminal of the first switching element T1 is connected to the CPU 91 of the control section 6 via the transmission path (not illustrated). In other words, a signal for switching the state of the first switching element T1 to an ON state is input from the control section 6 to the gate terminal of the first switching element T1.

A gate terminal of the second switching element T2 is connected to the CPU 91 of the control section 6 via the transmission path (not illustrated). In other words, a signal for switching the state of the second switching element T2 to an ON state is input from the control section 6 to the gate terminal of the second switching element T2.

The input terminal SC11 of the first switching circuit SC1 is connected to an output terminal SC23 of the second switching circuit SC2 via the transmission path. The input terminal SC12 of the first switching circuit SC1 is connected to an output terminal SC24 of the second switching circuit SC2 via the transmission path. The second switching circuit SC2 has two input terminals such as an input terminal SC21 and an input terminal SC22, in addition to the two output terminals such as the output terminal SC23 and the output terminal SC24.

As illustrated in FIG. 4, the second switching circuit SC2 is connected between the power source PS and the first switching circuit SC1. The second switching circuit SC2 is a circuit that controls the supply of the predetermined electric power supplied from the power source PS to the first switching circuit SC1. In the example illustrated in FIG. 4, the second switching circuit SC2 also removes noise from the predetermined electric power supplied from the power source PS.

The second switching circuit SC2 includes a breaker SG, a fuse HS, a resistor R, and a filter FT. The second switching circuit SC2 may not include the fuse HS, the resistor R, and the filter FT.

The input terminal SC21 of the second switching circuit SC2 is connected to one of the terminals of the fuse HS via the transmission path. The other one of the terminals of the fuse HS is connected to the input terminal of the breaker SG via the transmission path.

The breaker SG is, for example, a relay switch. The breaker SG may be another switching element such as a field effect transistor (FET) instead of the relay switch. The control terminal of the breaker SG is connected to the CPU 91 of the control section 6 via a transmission path (not illustrated). In other words, a signal for switching the state of the breaker SG to the ON state or the OFF state is input from the control section 6 to the control terminal of the breaker SG.

The output terminal of the breaker SG is connected respectively to one of the terminals of the resistor R and one of the two input terminals of the filter FT via the transmission path. The other one of the terminals of the resistor R is connected to each of the input terminal 22 and the other one of the two input terminals SC22 of the filter FT via the transmission path. One of the two output terminals of the filter FT is connected to the output terminal SC23 via the transmission path. The other one of the two output terminals of the filter FT is connected to the output terminal SC24 via the transmission path.

The filter FT is a filter that removes noise from the predetermined electric power supplied from the power source PS. The filter FT may be any filter as long as the filter can remove noise from the predetermined electric power supplied from the power source PS.

The input terminal SC21 of the second switching circuit SC2 is connected to the power source terminal PS1 included in the power source PS via the transmission path. The input terminal SC22 of the second switching circuit SC2 is connected to the power source terminal PS2 included in the power source PS via the transmission path.

The power source PS is an AC power source. The power source PS may be any power source as long as the power source is an AC power source.

With the circuit configuration as described above, the heater unit 40 causes some or all of the first end portion heating element 40A, the n central heating elements, and the second end portion heating element 40C to generate heat corresponding to the predetermined electric power supplied from the power source PS. Accordingly, the heater unit 40 can heat the tubular film 35 and heat the toner image through the heated tubular film 35.

When the state of the three switching elements such as the first switching element T1, the second switching element T2, and the breaker SG is a first state, the heater unit 40 heats the tubular film 35. The first state is a state where the state of the breaker SG is the ON state and the state of at least one of the first switching element T1 and the second switching element T2 is the ON state.

When the state of the three switching elements such as the first switching element T1, the second switching element T2, and the breaker SG is a second state, the heater unit 40 does not heat the tubular film 35. The second state is a state where the state of the breaker SG is the OFF state. In the second state, the respective states of the first switching element T1 and the second switching element T2 may be the ON state or the OFF state.

However, when the state of the breaker SG is the OFF state and the state of at least one state of the first switching element T1 and the second switching element T2 is the ON state, there is a case where the heater unit 40 heats the tubular film 35 at an unintended timing due to the noise from the power source PS. Here, the control section 6 performs switching control as described below. Accordingly, the image forming apparatus 1 can suppress unintended heating of the heater unit 40 due to noise from the power source PS. As a result, the image forming apparatus 1 can suppress deterioration of the tubular film 35.

Hereinafter, the process performed by the control section 6 will be described.

Figure 5:
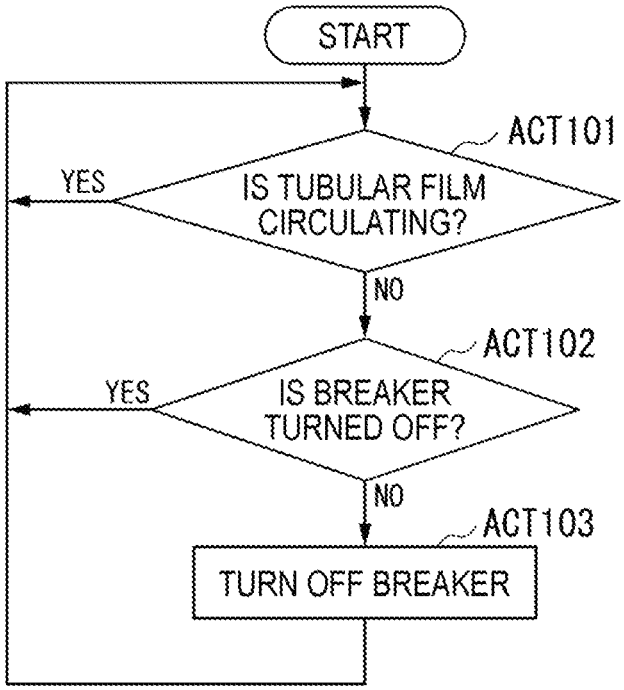
FIG. 5 is a flow diagram illustrating an example of a first process performed by a control section.

FIG. 5 is a diagram illustrating an example of a flow of a first process of processes performed by the control section 6. The first process is a process of switching the state of the breaker SG to the OFF state when the circulation of the tubular film 35 is stopped and when the state of the breaker SG is the ON state. The first process is a process of maintaining the state of the breaker SG to be the OFF state when the circulation of the tubular film 35 is stopped and when the state of the breaker SG is the OFF state. For example, while the image forming apparatus 1 is activated, the control section 6 repeatedly performs the process of the flowchart illustrated in FIG. 5.

The control section 6 determines whether or not the tubular film 35 is circulating (ACT 101). For example, when the motor that rotates the pressure roller 30*p* is not driven, the control section 6 determines that the tubular film 35 that circulates corresponding to the rotation of the pressure roller 30*p* is not circulating. For example, when the motor that rotates the pressure roller 30*p* is driven, the control section 6 determines that the tubular film 35 that circulates corresponding to the rotation of the pressure roller 30*p* is circulating. The control section 6 may be configured to determine whether or not the tubular film 35 is circulating by another method such as a method using a sensor.

When it is determined that the tubular film 35 is circulating (ACT 101—YES), the control section 6 returns to ACT 101 and determines again whether or not the tubular film 35 is circulating.

Meanwhile, when it is determined that the tubular film 35 is not circulating (ACT 101—NO), the control section 6 determines whether or not the state of the breaker SG is the OFF state (ACT 102). In FIG. 5, the process of ACT 102 is indicated by "IS BREAKER TURNED OFF?".

When it is determined that the state of the breaker SG is the OFF state (ACT 102—YES), the control section 6 returns to ACT 101 and determines again whether or not the tubular film 35 is circulating.

Meanwhile, when it is determined that the state of the breaker SG is not the OFF state (ACT 102—NO), the control section 6 switches the state of the breaker SG to the OFF state (ACT 103). In FIG. 5, the process of ACT 103 is indicated by "TURN OFF BREAKER". After the process of ACT 103 is performed, the control section 6 returns to ACT 101 and determines again whether or not the tubular film 35 is circulating.

As described above, the image forming apparatus 1 switches the state of the breaker SG to the OFF state when the circulation of the tubular film 35 is stopped and when the state of the breaker SG is the ON state. In addition, the image forming apparatus 1 maintains the state of the breaker SG to be the OFF state when the circulation of the tubular film 35 is stopped and when the state of the breaker SG is the OFF state. Accordingly, the image forming apparatus 1 can suppress unintended heating of the heater unit 40 due to noise from the power source PS. As a result, the image forming apparatus 1 can suppress deterioration of the tubular film 35.

Figure 6:
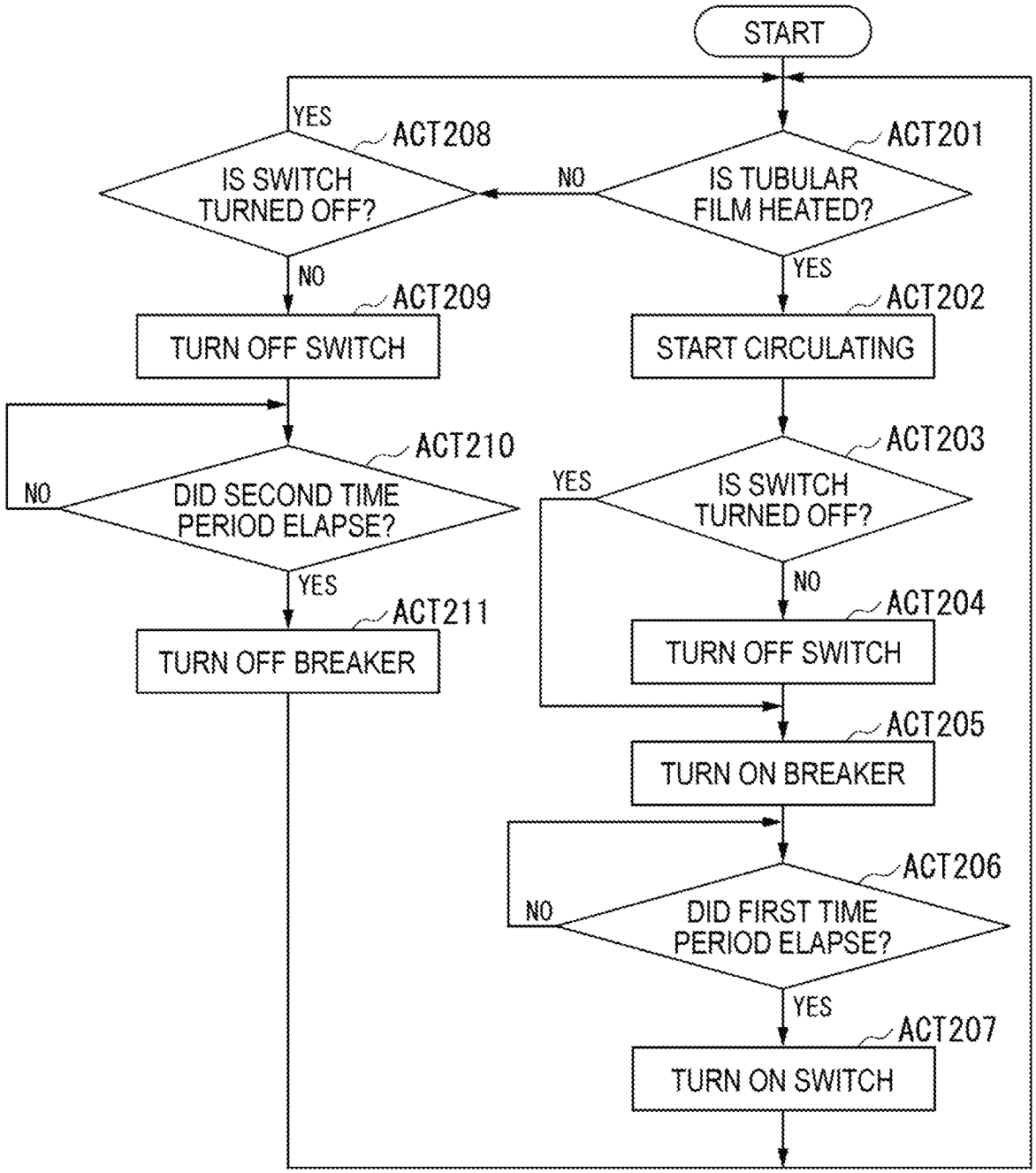
FIG. 6 is a flow diagram illustrating an example of a second process performed by the control section.

FIG. 6 is a diagram illustrating an example of a flow of a second process of processes performed by the control section 6. Hereinafter, for convenience of the description, at least one of the first switching element T1 and the second switching element T2 will be referred to as a switching element TO. Hereinafter, for convenience of the description, both the first switching element T1 and the second switching element T2 will be referred to as a switching element TA. The second process is a process of not switching the state of the breaker SG when the state of the switching element TO is the ON state. The second process is a process of maintaining the state of the breaker SG to be the OFF state when the tubular film 35 is not heated by the heater unit 40. The second process is a process of performing a 21st process described below when the heater unit 40 starts heating of the tubular film 35. The 21st process is a process of switching the state of the switching element TO to the ON state after switching the state of the breaker SG to the ON state while maintaining the state of the switching element TA to be the OFF state. The second process is a process of performing a 22nd process described below when the heater unit 40 ends heating of the tubular film 35. The 22nd process is a process of switching the state of the breaker SG to the OFF state after switching the state of the switching element TA to the OFF state. The second process is a process of switching the state of the breaker SG to the ON state corresponding to the start of the circulation of the tubular film 35. For example, while the image forming apparatus 1 is activated, the control section 6 repeatedly performs the process of the flowchart illustrated in FIG. 6.

The control section 6 determines whether to heat the tubular film 35 (ACT 201). For example, when an operation to start the process of forming an image on the sheet S is received, the control section 6 determines to heat the tubular film 35. For example, when the operation of starting the process of forming the image on the sheet S is not received, the control section 6 determines not to heat the tubular film 35. The control section 6 may be configured to determine whether to heat the tubular film 35 by another method.

When it is determined not to heat the tubular film 35 (ACT 201—NO), the control section 6 determines whether or not the state of the switching element TA is the OFF state (ACT 208). In FIG. 6, the process of ACT 208 is indicated by "IS SWITCH TURNED OFF?".

When it is determined that the state of the switching element TA is the OFF state (ACT 208—YES), the control section 6 returns to ACT 201 and determines again whether to heat the tubular film 35.

Meanwhile, when it is determined that the state of the switching element TA is not the OFF state (ACT 208—NO), the control section 6 switches the state of the switching element TA to the OFF state (ACT 209). In FIG. 6, the process of ACT 209 is indicated by "TURN OFF SWITCH".

Next, the control section 6 waits until a predetermined second time period elapses (ACT 210). The predetermined second time period is, for example, 50 milliseconds. The predetermined second time period may be less than 50 milliseconds and may be greater than 50 milliseconds.

When it is determined that the predetermined second time period elapsed (ACT 210—YES), the control section 6 switches the state of the breaker SG to the OFF state (ACT 211). In FIG. 6, the process of ACT 211 is indicated by "TURN OFF BREAKER". After the process of ACT 211 is performed, the control section 6 returns to ACT 201 and determines again whether to heat the tubular film 35.

Meanwhile, when it is determined that the tubular film 35 is heated (ACT 201—YES), the control section 6 controls the motor that rotates the pressure roller 30*p* and rotates the pressure roller 30*p*. Accordingly, the control section 6 starts the circulation of the tubular film 35 (ACT 202).

Next, the control section 6 determines whether or not the state of the switching element TA is the OFF state (ACT 203). In FIG. 6, the process of ACT 203 is indicated by "IS SWITCH TURNED OFF?".

When it is determined that the state of the switching element TA is the OFF state (ACT 203—YES), the control section 6 switches the state of the breaker SG to the ON state (ACT 205). In FIG. 6, the process of ACT 205 is indicated by "TURN ON BREAKER".

Meanwhile, when it is determined that the state of the switching element TA is not the OFF state (ACT 203—NO), the control section 6 switches the state of the switching element TA to the OFF state (ACT 204). In FIG. 6, the process of ACT 204 is indicated by "TURN OFF SWITCH". After the process of ACT 204 is performed, the control section 6 transits to ACT 205.

After the process of ACT 205 is performed, the control section 6 waits until the predetermined first time period elapses (ACT 206). The predetermined first time period is, for example, 50 milliseconds. The predetermined first time period may be less than 50 milliseconds and may be greater than 50 milliseconds. The predetermined first time period may be the same time period as the predetermined second time period or may be a time period different from the predetermined second time period.

When it is determined that the predetermined first time period elapsed (ACT 206—YES), the control section 6 switches the state of the switching element TO to the ON state (ACT 207). In FIG. 6, the process of ACT 207 is indicated by "TURN ON SWITCH". After the process of ACT 207 is performed, the control section 6 returns to ACT 201.

Here, the flow of the process of ACT 201→ACT 202→ACT 203→ACT 204→ACT 205→ACT 206→ACT 207→ACT 201 is, for example, a flow of a process of starting heating of the tubular film 35. In other words, the image forming apparatus 1 performs the 21st process as described above when the heater unit 40 starts heating of the tubular film 35. As described above, the 21st process is a process of switching the state of the switching element TO to the ON state after switching the state of the breaker SG to the ON state while maintaining the state of the switching element TA to be the OFF state. Accordingly, the image forming apparatus 1 can suppress shortening of the life of the breaker SG.

The flow of the process of ACT 201→ACT 202→ACT 203→ACT 204→ACT 205→ACT 206→ACT 207→ACT 201 may be, for example, a flow of a process of starting circulation of the tubular film 35. In other words, the image forming apparatus 1 switches the state of the breaker SG to the ON state corresponding to the start of the circulation of the tubular film 35. Accordingly, the image forming apparatus 1 can more reliably suppress deterioration of the tubular film 35 caused by unintended heating due to noise from the power source PS.

The flow of the process of ACT 201→ACT 208→ACT 201 is, for example, a flow of a process of not heating the tubular film 35 by the heater unit 40. In other words, the image forming apparatus 1 maintains the state of the breaker SG to be the OFF state when the tubular film 35 is not heated by the heater unit 40.

The flow of the process of ACT 201→ACT 208→ACT 209→ACT 210→ACT 211→ACT 201 is, for example, a flow of a process of ending heating of the tubular film 35. In other words, the image forming apparatus 1 performs the 22nd process as described above when the heater unit 40 ends heating of the tubular film 35. As described above, the 22nd process is a process of switching the state of the breaker SG to the OFF state after switching the state of the switching element TA to the OFF state. Accordingly, the image forming apparatus 1 can suppress shortening of the life of the breaker SG.

Furthermore, the process of the flowchart illustrated in FIG. 6 may be a process of not switching the state of the breaker SG when the state of the switching element TO is the ON state. Accordingly, the image forming apparatus 1 can suppress shortening of the life of the breaker SG.

In addition, the image forming apparatus 1 may include any one of the first switching element T1 and the second switching element T2 in the first switching circuit SC1. In this case, in the image forming apparatus 1, the heating of the first end portion heating element 40A, the n central heating elements, and the second end portion heating element 40C is respectively controlled by any one of the first switching element T1 and the second switching element T2.

As described above, the image forming apparatus (the image forming apparatus 1 in this example) includes the fixing belt (the tubular film 35 in this example), the heating device (the heater unit 40 in this example), the switching element (the switching element TO in this example), the breaker (the breaker SG in this example), and the control section (the control section 6 in this example). The fixing belt is provided so as to be capable of circulating and comes into contact with a sheet (the sheet S in this example) to which a toner image is transferred. The heating device heats the fixing belt and heats the toner image through the heated fixing belt. The switching element supplies the heating device with electric power supplied from a power source. The breaker is connected between the power source and the switching element. The control section switches the state of the breaker to the OFF state when the state of the breaker is the ON state, when circulation of the fixing belt is stopped. The control section maintains the state of the breaker to be the OFF state when the state of the breaker is the OFF state, when circulation of the fixing belt is stopped. Accordingly, the image forming apparatus can suppress unintended heating of the heating device due to noise from the power source.

Further, in the image forming apparatus, the switching element may be a triac.

Further, in the image forming apparatus, the breaker may be a relay switch.

Further, the control section may not switch the state of the breaker when the state of the switching element is the ON state.

Further, the control section may maintain the state of the breaker to be the OFF state when the fixing belt is not heated by the heating device.

In addition, when causing the heating device to start heating of the fixing belt, the control section may switch the state of the switching element to the ON state after switching the state of the breaker to the ON state while maintaining the state of the switching element to be the OFF state.

Further, when causing the heating device to start heating of the fixing belt, the control section may switch the state of the breaker to the ON state while maintaining the state of the switching element to be the OFF state, and switch the state of the switching element to the ON state after a predetermined first time elapsed after the state of the breaker is switched to the ON state.

In addition, when causing the heating device to end heating of the fixing belt, the control section may switch the state of the breaker to the OFF state after switching the state of the switching element to the OFF state.

Further, when causing the heating device to end heating of the fixing belt, the control section may switch the state of the switching element to an OFF state, and switch the state of the breaker to the OFF state after a predetermined second time period elapsed after the state of the switching element is switched to the OFF state.

Further, the control section may switch the state of the breaker to the ON state corresponding to the start of the circulation of the fixing belt.

In addition, a program for realizing the function of any component in the above-described apparatus (for example, the image forming apparatus 1) may be recorded in a computer-readable recording medium, and read and executed by a computer system. Note that the "computer system" as used herein includes an operating system (OS) and hardware such as a peripheral device. The "computer-readable recording medium" refers to a portable medium such as a flexible disk, a magneto-optical disk, a ROM, and a CD (compact disk)-ROM, and a storage device such as a hard disk installed in a computer system. Further, the "computer-readable recording medium" may also include such a medium that stores programs for a certain period of time such as volatile memory (RAM) inside a computer system that functions as a server or a client when a program is transmitted via a network such as the Internet and a communication line such as a telephone line.

Further, the above-described program may be transmitted from a computer system in which this program is stored in a storage device or the like to another computer system via a transmission medium or by a transmission wave in the transmission medium. Here, the "transmission medium" for transmitting the program means a medium having a function of transmitting information such as a network (communication network) such as the Internet or a communication channel (communication line) such as a telephone line.

Further, the above-described program may be for realizing a part of the above-described functions. Furthermore, the above-described program may be a so-called differential file (differential program) that can be realized by combining the above-described functions with a program which is already recorded in the computer system.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a fixing belt configured to circulate, the fixing belt positioned to contact a sheet to which a toner image is transferred;

a heater unit disposed within the fixing belt, the heater unit including:

an input;

a heater configured to heat the fixing belt and thereby heat the toner image via the fixing belt;

a thermometer positioned proximate the heater; and a power transmission line electrically coupling the input to the thermometer and the thermometer to the heater;

a switch configured to selectively supply the heater unit with electric power provided by a power source;

a breaker connected between the power source and the switch, the breaker operable in an OFF state and an ON state; and a controller configured to:

switch the breaker to the OFF state from the ON state; and maintain the breaker in the OFF state when (i) the breaker is in the OFF state and (ii) circulation of the fixing belt is stopped.

2. The image forming apparatus of claim 1, wherein the switch is a triac, a gate turn-off thyristor, or an insulated gate bipolar transistor.

3. The image forming apparatus of claim 1, wherein the breaker is a relay switch.

4. The image forming apparatus of claim 1, wherein the controller is configured to not switch the breaker to the OFF state when the switch is in an ON state.

5. The image forming apparatus of claim 1, wherein the controller is configured to maintain the breaker in the OFF state when the fixing belt is not heated by the heater.

6. The image forming apparatus of claim 5, wherein, the controller is configured to:

cause the heater to start heating the fixing belt; and switch the breaker to the ON state while maintaining the switch in an OFF state and, thereafter, switch the switch to an ON state.

7. The image forming apparatus of claim 6, wherein the controller is configured to switch the switch to the ON state after a predetermined time period elapses after the breaker is switched to the ON state.

8. The image forming apparatus of claim 5, wherein the controller is configured to:

cause the heater to stop heating the fixing belt; and switch the switch to an OFF state and, thereafter, switch the breaker to the OFF state.

9. The image forming apparatus of claim 8, wherein the controller is configured to switch the breaker to the OFF state after a predetermined time period elapses after the switch is switched to the OFF state.

10. The image forming apparatus of claim 1, wherein the controller is configured to switch the breaker to the ON state corresponding to start of circulation of the fixing belt.

11. The image forming apparatus of claim 1, wherein the controller is configured to switch the breaker to the OFF state when the state of the breaker is the ON state and at least one of (i) the fixing belt in not circulating or (ii) the heater is not heating the fixing belt.

12. A method for controlling operation of an image forming apparatus, the method comprising:

providing the image forming apparatus including a fixing belt, a heater unit disposed within the fixing belt, a switch configured to selectively supply the heater unit with electric power provided by a power source, a breaker (i) connected between the power source and the switch and (ii) operable in an OFF state and an ON state, and a processing circuit, wherein the heater unit includes (i) an input, (ii) a heater configured to heat the fixing belt, (iii) a thermometer positioned proximate the heater, and (iv) a power transmission line electrically coupling the input to the thermometer and the thermometer to the heater;

switching, by the processing circuit, the breaker to the OFF state from the ON state; and maintaining, by the processing circuit, the breaker in the OFF state when (i) the breaker is in the OFF state and (ii) circulation of the fixing belt is stopped.

13. The method of claim 12, wherein the switch is at least one of a triac, a gate turn-off thyristor, or an insulated gate bipolar transistor, and wherein the breaker is a relay switch.

14. The method of claim 12, further comprising preventing, by the processing circuit, the breaker from being switched to the OFF state when the switch is in an ON state.

15. The method of claim 12, wherein the processing circuit is configured to maintain the breaker in the OFF state when (i) the breaker is in the OFF state, (ii) circulation of the fixing belt is stopped, and (iii) the fixing belt is not heated by the heater.

16. The method of claim 12, further comprising:

causing, by the processing circuit, the heater to start heating the fixing belt;

switching, by the processing circuit, the breaker to the ON state while maintaining the switch in an OFF state in response to the heating of the fixing belt; and switching, by the processing circuit, the switch to the ON state after a predetermined time period elapses after the breaker is switched to the ON state.

17. The image forming apparatus of claim 16, further comprising:

causing, by the processing circuit, the fixing belt to circulate; and switching, by the processing circuit, the breaker to the ON state while maintaining the switch in an OFF state in response to the heating of the fixing belt and the circulation of the fixing belt.

18. The method of claim 12, further comprising:

causing, by the processing circuit, the heater to stop heating the fixing belt;

switching, by the processing circuit, the switch to an OFF state in response to stopping the heating of the fixing belt; and switching, by the processing circuit, the breaker to the OFF state after a predetermined time period elapses after the switch is switched to the OFF state.

19. An image forming apparatus comprising:

a fixing belt;

a heater unit disposed within the fixing belt, the heater unit including:

an input configured to receive power from a power source;

a heater including a plurality of heating elements positioned to heat the fixing belt, the plurality of heating elements including at least a first heating element and a second heating element;

a thermostat positioned proximate the first heating element;

a thermometer positioned proximate the second heating element; and a power transmission line electrically coupling the input to the thermostat, the thermostat to the thermometer, and the thermometer to the first heating element and the second heating element such that the power from the power source flows from the input to the thermostat, from the thermostat to the thermometer, and from the thermometer to the first heating element and the second heating element;

a switch circuit electrically coupled to the input of the heater unit, wherein the switch circuit is not positioned along the power transmission line; and a breaker electrically coupled to the switch circuit, the breaker configured to electrically couple to the power source.

20. The image forming apparatus of claim 19, wherein the first heating element is a first end heating element positioned proximate a first end of the heater unit, wherein the second heating element is a second end heating element positioned proximate a second end of the heater unit, wherein the thermostat is a first thermostat, wherein the thermometer is a first thermometer, wherein the plurality of heating elements include a plurality of central heating elements positioned between the first end heating element and the second send heating element, wherein the plurality of central heating elements include at least a first central heating element and a second central heating element, further comprising (i) a second thermostat positioned proximate the first central heating element and (ii) a second thermometer positioned proximate the second central heating element, wherein the power transmission line electrically couples the input to the first thermostat, the first thermostat to the second thermostat, the second thermostat to the second thermometer, the second thermometer to the first thermometer, and the first thermometer to the first end heating element, the second end heating element, the first central heating element, and the second central heating element.

* * * * *